US011777222B2

(12) United States Patent
Fang et al.

(10) Patent No.: US 11,777,222 B2
(45) Date of Patent: Oct. 3, 2023

(54) SLOT ANTENNA AND COMMUNICATION DEVICE

(71) Applicant: BOE TECHNOLOGY GROUP CO., LTD., Beijing (CN)

(72) Inventors: Jia Fang, Beijing (CN); Feng Qu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 187 days.

(21) Appl. No.: 17/360,185

(22) Filed: Jun. 28, 2021

(65) Prior Publication Data

US 2021/0408692 A1 Dec. 30, 2021

(30) Foreign Application Priority Data

Jun. 28, 2020 (CN) ..... 202010594132.7

(51) Int. Cl.

| | |
|---|---|
| ***H01Q 13/10*** | (2006.01) |
| ***H01Q 1/38*** | (2006.01) |
| ***H01Q 1/40*** | (2006.01) |
| ***H01Q 21/06*** | (2006.01) |

(52) U.S. Cl.

CPC ..... *H01Q 13/10* (2013.01); *H01Q 1/38* (2013.01); *H01Q 1/40* (2013.01); *H01Q 21/064* (2013.01)

(58) Field of Classification Search

CPC ..... H01Q 13/10; H01Q 1/38; H01Q 1/40; H01Q 21/064; H01Q 21/0012; H01Q 1/36; H01Q 1/48

See application file for complete search history.

(56) References Cited

U.S. PATENT DOCUMENTS

| | | | | |
|---|---|---|---|---|
| 9,905,921 | B2 * | 2/2018 | Sazegar | H01Q 21/061 |
| 2016/0261042 | A1 * | 9/2016 | Sazegar | H01Q 21/064 |
| 2018/0115063 | A1 | 4/2018 | Sazegar et al. | |
| 2018/0219299 | A1 * | 8/2018 | Boutayeb | H01Q 21/0056 |
| 2019/0237873 | A1 * | 8/2019 | Sazegar | H01Q 21/20 |
| 2021/0336316 | A1 * | 10/2021 | Raphaeli | H01Q 21/0006 |

FOREIGN PATENT DOCUMENTS

| | | | |
|---|---|---|---|
| CN | 104600419 | A | 5/2015 |
| CN | 105960736 | A | 9/2016 |
| CN | 107394367 | A | 11/2017 |
| CN | 108242600 | A | 7/2018 |

(Continued)

OTHER PUBLICATIONS

China Patent Office, CN202010594132.7 First Office Action dated Aug. 11, 2022.

(Continued)

*Primary Examiner* — David E Lotter

(74) *Attorney, Agent, or Firm* — HOUTTEMAN LAW LLC

(57) ABSTRACT

A slot antenna and a communication device including the slot antenna are provided. The slot antenna includes: a dielectric layer having a first surface and a second surface opposite to each other, a radiation layer on the first surface of the dielectric layer and having a plurality of slots therein, and a first shielding layer on the second surface of the dielectric layer and electrically connected to the radiation layer.

20 Claims, 4 Drawing Sheets

(56) References Cited

FOREIGN PATENT DOCUMENTS

| | | | |
|---|---|---|---|
| CN | 110635238 | A | 12/2019 |
| KR | 20080063431 | A | 7/2008 |

OTHER PUBLICATIONS

Koli et al., "Analyzing the Coupling from Radiating Slots in a Double-Layered Radial Line Slot Array Antenna," Conference Paper, 2019 IEEE International Symposium on Antennas and Propagation and USNC-URSI Radio Science Meeting, Oct. 31, 2019, pp. 1427-1428, IEEE.

China Patent Office, CN202010594132.7 First Office Action dated Feb. 14, 2022.

Yin Yufeng, "Study the single-layer circularly polarized waveguide slot antenna" issued on Jan. 15, 2019 and the English abstract attached, Master's Thesis, Nanjing University of Science and Technology.

* cited by examiner

SLOT ANTENNA AND COMMUNICATION DEVICE

CROSS REFERENCE TO RELATED APPLICATIONS

The present application claims priority to Chinese patent application No. 202010594132.7, filed on Jun. 28, 2020, the content of which is incorporated herein by reference in its entirety.

TECHNICAL FIELD

The present disclosure relates to the field of communication technologies, and in particular to a slot antenna and a communication device.

BACKGROUND

A radial line slot antenna has advantages of small loss of a waveguide slot array, a simple structure of a microstrip antenna, and a low section, and thus is widely applied to microwave systems such as a millimeter wave system. Generally, the radial line slot antenna includes an upper metal plate and a lower metal plate with a distance therebetween less than ½ of a wavelength, to form a radial waveguide, and includes designed slots formed in the upper metal plate, thereby achieving any polarization mode or radiation characteristic.

SUMMARY

Some embodiments of the present disclosure provide a slot antenna and a communication device including the slot antenna.

A first aspect of the present disclosure provides a slot antenna, which includes:

a dielectric layer having a first surface and a second surface opposite to each other;

a radiation layer on the first surface of the dielectric layer, and having a plurality of slots therein; and a first shielding layer on the second surface of the dielectric layer, and electrically connected to the radiation layer.

In an embodiment, the slot antenna has a radiation region and a peripheral region surrounding the radiation region;

the dielectric layer includes a first sub-dielectric layer and a second sub-dielectric layer, a surface of the first sub-dielectric layer distal to the second sub-dielectric layer serves as the first surface of the dielectric layer, and a surface of the second sub-dielectric layer distal to the first sub-dielectric layer serves as the second surface of the dielectric layer; and the slot antenna further includes a second shielding layer between the first sub-dielectric layer and the second sub-dielectric layer and within the radiation region.

In an embodiment, the slot antenna has a radiation region and a peripheral region surrounding the radiation region, at least one through hole penetrating through the dielectric layer is arranged in the peripheral region, and the radiation layer is electrically connected to the first shielding layer through the at least one through hole penetrating through the dielectric layer.

In an embodiment, the at least one through hole includes a plurality of through holes, and the plurality of through holes are uniformly arranged around the radiation region.

In an embodiment, the plurality of slots are arranged in a plurality of loops, a distance between any adjacent two of the slots in each loop is a fixed value, and a distance between any adjacent two of the plurality of loops is a fixed value.

In an embodiment, the plurality of slots are arranged in a spiral line, and a distance between any adjacent two of the slots in a direction in which the plurality of slots are arranged is a fixed value.

In an embodiment, the slot antenna further includes a feeding element for feeding an electromagnetic wave signal into the dielectric layer, wherein a feeding point of the feeding element is on a central axis of the slot antenna.

In an embodiment, a material of the dielectric layer includes at least one of glass and quartz.

In an embodiment, a thickness of the dielectric layer has a positive correlation with a wavelength of an electromagnetic wave to be transmitted by the slot antenna.

In an embodiment, the dielectric layer has a thickness between 100 μm and 10 mm.

In an embodiment, a material of each of the radiation layer and the first shielding layer includes a metal.

In an embodiment, the metal includes at least one of copper, gold, and silver.

In an embodiment, a thickness of the dielectric layer is equal to a sum of a thickness of the first sub-dielectric layer and a thickness of the second sub-dielectric layer, and has a positive correlation with a wavelength of an electromagnetic wave to be transmitted by the slot antenna.

In an embodiment, the slot antenna has a shape of a cylinder or a cube, the feeding element is on a central axis of the cylinder or the cube, and the dielectric layer surrounds the feeding element.

In an embodiment, the feeding element is in the second sub-dielectric layer.

In an embodiment, an edge of the second shielding layer is spaced apart from the peripheral region.

In an embodiment, each of the plurality of loops is a circle, and the plurality of loops are concentric circles.

In an embodiment, a starting point of the spiral line is on a central axis of the slot antenna.

In an embodiment, each of the plurality of slots has an L-shape or an I-shape.

A second aspect of the present disclosure provides a communication device, which includes the slot antenna according to any one of the foregoing embodiments of the first aspect of the present disclosure.

DETAILED DESCRIPTION

Figure 1:
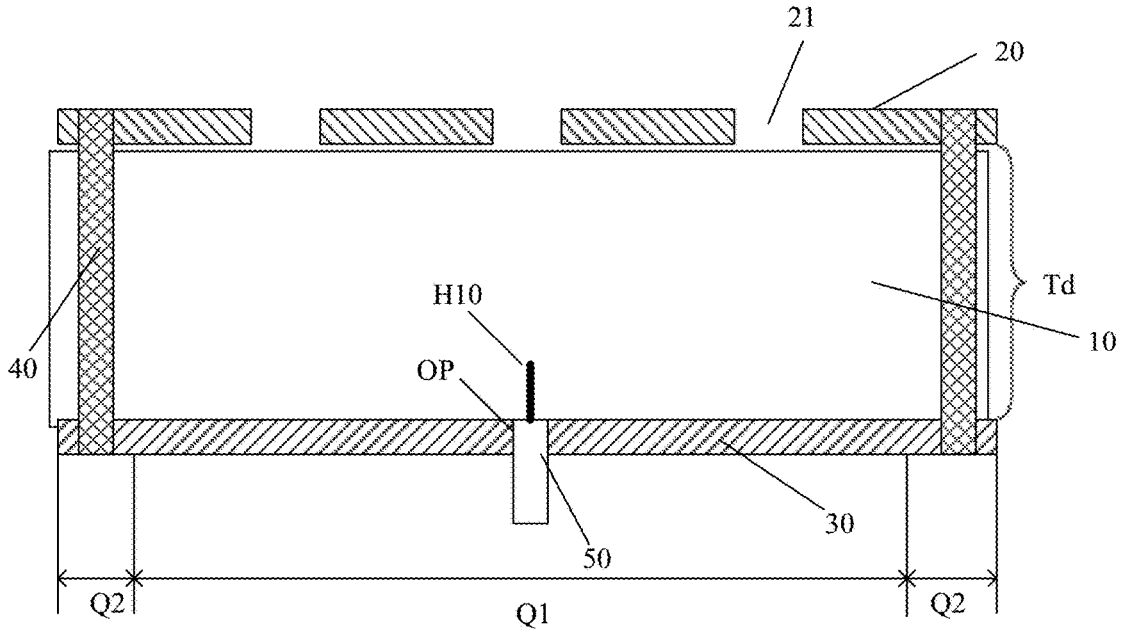
FIG. 1 is a schematic diagram showing a structure of a slot antenna according to an embodiment of the present disclosure; for example, the slot antenna may have a shape of a pillar, and FIG. 1 may be a cross-sectional view taken along a plane including a central axis of the pillar.

To enable one of ordinary skill in the art to better understand technical solutions of the present disclosure, the present disclosure will be further described in detail below with reference to the accompanying drawings and exemplary embodiments.

Unless defined otherwise, technical or scientific terms used herein should have the same meaning as commonly understood by one of ordinary skill in the art to which the present disclosure belongs. The terms of "first", "second", and the like herein are not intended to indicate any order, quantity, or importance, but rather are used for distinguishing one element from another. Further, the terms of "a", "an", "the", or the like used herein does not denote a limitation of quantity, but rather denote the presence of at least one element. The term of "comprising", "including", or the like, means that the element or item preceding the term contains the element or item listed after the term and the equivalent thereof, but does not exclude the presence of other elements or items. The terms "connected", "coupled", and the like are not limited to physical or mechanical connections, but may include electrical connections, whether direct or indirect connections. The terms "upper", "lower", "left", "right", and the like are used only for indicating relative positional relationships, and when the absolute position of an object being described is changed, the relative positional relationships may also be changed accordingly.

The inventors of the present inventive concept have found that, although an efficiency of the radial line slot antenna is increased as a size thereof is increased, a processing mode for the metal waveguide may result in significant deformation in large-area manufacturing, thereby having an influence on a distance between radial waveguides. In addition, as an operating frequency of the radial line slot antenna is increased, a size of each slot of the radial line slot antenna for radiating a signal (e.g., an electromagnetic wave) outward and a distance between two adjacent slots of the radial line slot antenna may be further reduced, such that a machining process cannot meet the design requirements.

At least to solve the above technical problems, some embodiments of the present disclosure provide a slot antenna (e.g., a radial line slot antenna) and a communication device including the slot antenna.

It should be noted that a structure of the slot antenna according to embodiments of the present disclosure includes, but is not limited to, a cylinder, a rectangular parallelepiped, a cube, and the like. In the following description of the embodiments, the structure of the slot antenna as a cylinder is generally described. In an embodiment of the present disclosure, a material of a dielectric layer of the slot antenna includes, but is not limited to, glass, i.e., the dielectric layer may be a glass dielectric layer. Actually, the material of the dielectric layer may be any insulating material such as quartz that is suitable for forming a planar surface structure. The following embodiments will be described by taking an example in which the dielectric layer is a glass dielectric layer, but this is not intended to limit the scope of the present disclosure.

Figure 2:
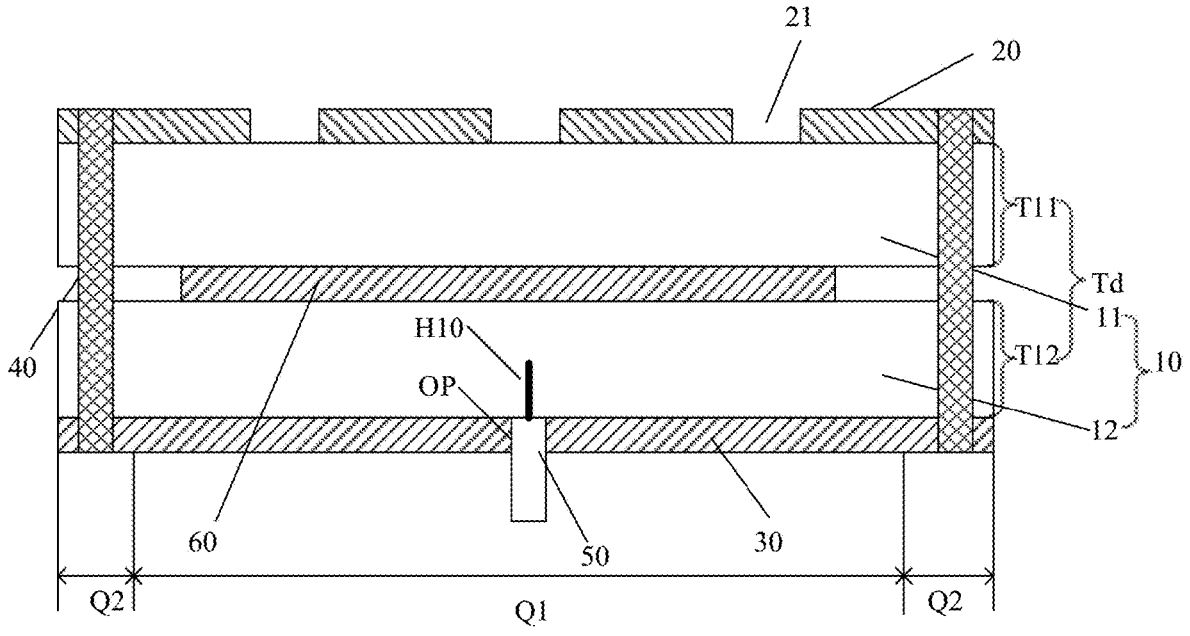
FIG. 2 is a schematic diagram showing a structure of a slot antenna according to another embodiment of the present disclosure; for example, the slot antenna may have a shape of a pillar, and FIG. 2 may be a cross-sectional view taken along a plane including a central axis of the pillar.
Figure 3:
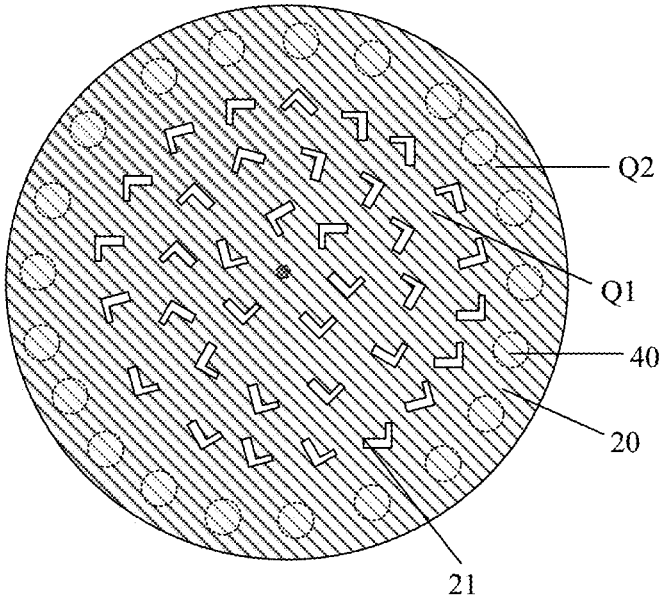
FIG. 3 is a schematic top view of a slot antenna (e.g., a plan view of an end of the slot antenna shown in FIG. 1 or 2 where a radiation layer is located) according to an embodiment of the present disclosure.

In a first aspect, FIG. 1 is a schematic diagram showing a structure of a slot antenna according to an embodiment of the present disclosure. FIG. 2 is a schematic diagram showing a structure of a slot antenna according to an embodiment of the present disclosure, and FIG. 3 is a schematic top view of a slot antenna according to an embodiment of the present disclosure. As shown in FIGS. 1 to 3, some embodiments of the present disclosure provide a slot antenna, such as a radial line slot antenna. The slot antenna includes a glass dielectric layer 10, a first shielding layer 30, and a radiation layer 20. The glass dielectric layer 10 includes a first surface and a second surface disposed opposite to each other. The first surface is, for example, an upper surface of the glass dielectric layer 10 shown in FIG. 1 or 2, and the second surface is, for example, a lower surface of the glass dielectric layer 10 shown in FIG. 1 or 2. The radiation layer 20 is disposed on the first surface of the glass dielectric layer 10, and the radiation layer 20 has slots 21 therein. The first shielding layer 30 is disposed on the second surface of the glass dielectric layer 10, and is electrically connected to the radiation layer 20 disposed on the first surface of the glass dielectric layer 10. For example, the slot antenna may further include a feeding element (e.g., signal feeding element) 50 or the like, and for example, the feeding element 50 may feed an electromagnetic wave into the glass dielectric layer 10 through the first shielding layer 30.

The dielectric layer of the slot antenna according to the present embodiment adopts a glass substrate, i.e., the dielectric layer is the glass dielectric layer 10. It should be noted that glass has a high dielectric constant (i.e., a permittivity), and thus can significantly reduce a dielectric wavelength of an electromagnetic wave. A size (e.g., a thickness Td) of the glass dielectric layer 10 in a stacking direction (i.e., the vertical direction in FIG. 1) of the radiation layer 20, the glass dielectric layer 10, and the first shielding layer 30 is positively correlated with a wavelength of an electromagnetic wave to be transmitted by the slot antenna, and thus, a size of the slot antenna can be effectively reduced by using the glass dielectric layer 10. Meanwhile, since glass has a very flat (or planar) surface and the thickness Td is uniform at various positions. As such, the uniformity of the radial waveguide in a longitudinal direction (e.g., a direction along a central axis of the slot antenna) can be maintained, and the radial waveguide here is a waveguide in a radial direction (e.g., a direction from the feeding element 50 to the left or right in FIG. 1 or 2, or a direction from the feeding element 50 to the outer periphery of the first shielding layer 30 in FIG. 3).

In an example, the glass dielectric layer 10 of the slot antenna is a single-layer structure, as shown in FIG. 1. The slot antenna has a peripheral region Q2 and a radiation region Q1. For example, the radiation region Q1 is a region having a plurality of slots 21 but not having any through hole 40 therein, and the peripheral region Q2 is a region having at least one through hole 40 but not having any slot 21 therein. The at least one through hole 40 is provided in the peripheral region Q2 of the glass dielectric layer 10, and the radiation layer 20 and the first shielding layer 30 are electrically connected to each other through the at least one through hole 40. In some embodiments, the at least one through hole 40 include a plurality of through holes 40, and the plurality of through holes 40 are uniformly arranged around the radiation region Q1. In this way, the radiation layer 20 and the first shielding layer 30 can be electrically connected to each other effectively. Alternatively, the radiation layer 20 may also be connected (e.g., electrically connected) to the first shielding layer 30 through a wire on an edge of the glass dielectric layer 10. For example, each through hole 40 in the glass dielectric layer 10 according to an embodiment of the present disclosure may be a through glass via (TGV), and a metal conductive layer may be formed on an inner wall of each through hole 40 or a metal may be filled in each through hole 40. The radiation layer 20 and the first shielding layer 30 may be formed on the first surface and the second surface of the glass dielectric layer 10 by using an electroplating process, respectively. The slots 21 in the radiation layer 20 may be formed by a patterning process. The thickness Td of the glass dielectric layer 10 depends on an operating frequency of the slot antenna (i.e., a frequency of an electromagnetic wave to be transmitted by the slot antenna). The thickness Td of the glass dielectric layer 10 should be smaller as the operating frequency of the slot antenna is higher (in other words, the thickness Td of the glass dielectric layer 10 should be larger as a wavelength of the electromagnetic wave to be transmitted by the slot antenna is greater, i.e., the thickness Td of the glass dielectric layer 10 has a positive correlation with the wavelength of the electromagnetic wave to be transmitted by the slot antenna). That is, in an embodiment of the present disclosure, the thickness Td of the glass dielectric layer 10 may be set according to the operating frequency of the slot antenna. In an embodiment of the present disclosure, the glass dielectric layer 10 may be a single-layer structure of glass (as shown in FIG. 1) or a multi-layer structure of glass (as shown in FIG. 2).

Figure 4:
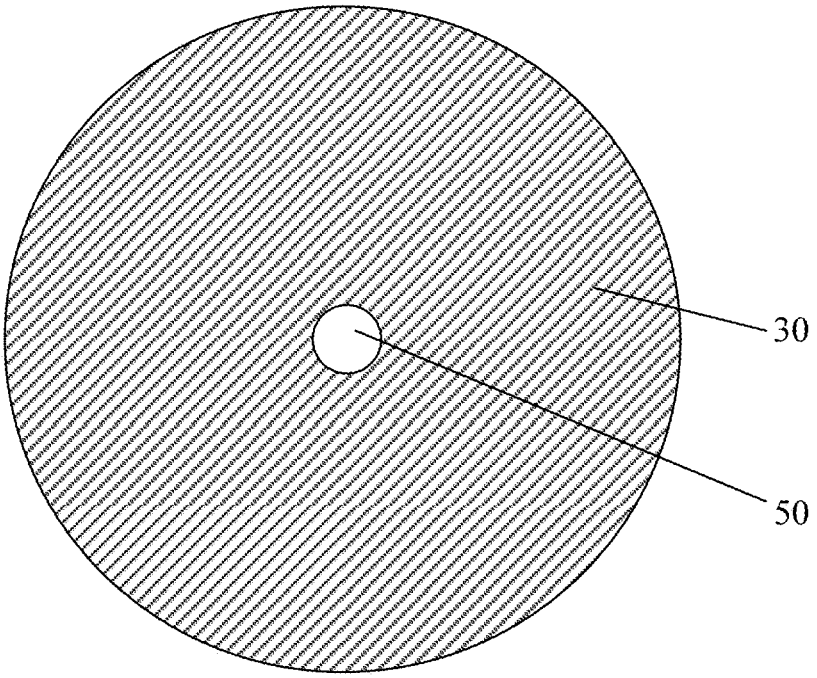
FIG. 4 is a schematic bottom view of a slot antenna (e.g., a plan view of an end of the slot antenna shown in FIG. 1 or 2 where a first shielding layer is located) according to an embodiment of the present disclosure.

In another example, FIGS. 2 and 4 are schematic structural diagrams of another slot antenna according to an embodiment of the present disclosure. As shown in FIGS. 2 and 4, the slot antenna has the peripheral region Q2 and the radiation region Q1. The glass dielectric layer 10 of the slot antenna includes a first sub-dielectric layer 11 and a second sub-dielectric layer 12, and the slot antenna further includes a second shielding layer 60 disposed between the first sub-dielectric layer 11 and the second sub-dielectric layer 12. An edge of the second shielding layer 60 (e.g., each of the left and right ends of the second shielding layer 60 shown in FIG. 2) has a certain distance from the peripheral region Q2 or any through hole 40 (i.e., the edge does not extend into the peripheral region Q2 or any through hole 40), thereby allowing a signal fed into the slot antenna by the feeding element 50 to be transmitted from the second sub-dielectric layer 12 to the first sub-dielectric layer 11. For example, a surface of the first sub-dielectric layer 11 distal to the second sub-dielectric layer 12 serves as the first surface of the glass dielectric layer 10, and a surface of the second sub-dielectric layer 12 distal to the first sub-dielectric layer 11 serves as the second surface of the glass dielectric layer 10. The radiation layer 20 is formed on the surface of the first sub-dielectric layer 11 distal to the second sub-dielectric layer 12, and the first shielding layer 30 is formed on the surface of the second sub-dielectric layer 12 distal to the first sub-dielectric layer 11. The radiation layer 20 and the first shielding layer 30 are connected to each other through at least one through hole 40 penetrating through the first sub-dielectric layer 11 and the second sub-dielectric layer 12. The second shielding layer 60 may be formed on a surface of the first sub-dielectric layer 11 proximal to the second sub-dielectric layer 12 and/or on a surface of the second sub-dielectric layer 12 proximal to the first sub-dielectric layer 11. In the following description, an example in which the second shielding layer 60 is formed on the surface of the first sub-dielectric layer 11 proximal to the second sub-dielectric layer 12 is taken. Each through hole 40 in the first sub-dielectric layer 11 and the second sub-dielectric layer 12 may be a through glass via (TGV), and a metal conductive layer may be formed on the inner wall of each through hole 40 or a metal may be filled in each through hole 40. The radiation layer 20 and the second shielding layer 60 may be formed on an upper surface and a lower surface of the first sub-dielectric layer 11 by using an electroplating process, respectively, and the slots 21 in the radiation layer 20 may be formed by a patterning process. The first shielding layer 30 may be formed on a lower surface of the second sub-dielectric layer 12 by an electroplating process. The first sub-dielectric layer 11 and the second sub-dielectric layer 12 may be aligned with each other and assembled into a cell by a vacuum assembly system (VAS), thereby forming a feeding double-layer having extremely high alignment accuracy. As described above, the thickness Td of the glass dielectric layer 10 depends on the operating frequency of the slot antenna, and the thickness Td of the glass dielectric layer 10 should be smaller as the operating frequency is higher. In the slot antenna shown in FIG. 2, the glass dielectric layer 10 includes the first sub-dielectric layer 11 and the second sub-dielectric layer 12, and in this case, the thickness Td of the glass dielectric layer 10 is equal to a sum of a thickness T11 of the first sub-dielectric layer 11 and a thickness T12 of the second sub-dielectric layer 12, i.e., Td=T11+T12. That is, in the present embodiment, the thickness T11 of the first sub-dielectric layer 11 and the thickness T12 of the second sub-dielectric layer 12 of the glass dielectric layer 10 may be designed according to the operating frequency of the slot antenna, such that the sum of the thickness T11 and the thickness T12 has a positive correlation with the wavelength of the electromagnetic wave to be transmitted by the slot antenna. In the present embodiment, each of the first sub-dielectric layer 11 and the second sub-dielectric layer 12 may be a single-layer structure of glass or a multi-layer structure of glass.

In the slot antenna with such a structure, there is no electrical connection between the second shielding layer 60 and any through hole 40, and the second shielding layer 60 mainly serves to uniformly distribute the an electromagnetic wave fed into the glass dielectric layer 10. For example, the electromagnetic wave fed by the feeding element 50 enters the second sub-dielectric layer 12 firstly, and next propagates from a central axis of the second sub-dielectric layer 12 to the second shielding layer 60 along a longitudinal direction of the slot antenna (e.g., a direction from the position of the feeding element 50 to a midpoint of the first surface (i.e., the upper surface) of the dielectric layer 10 in FIG. 1 or 2). Then the electromagnetic wave propagates around the edge of the second shielding layer 60 to the first sub-dielectric layer 11. In this way, the electromagnetic wave propagates from a center of the second sub-dielectric layer 12 to an edge of the second sub-dielectric layer 12, and propagates from an edge of the first sub-dielectric layer 11 to a center of the first sub-dielectric layer 11. Then, the electromagnetic wave is radiated outward from the slots 21 in the radiation layer 20, such that the electromagnetic wave is transmitted more uniformly.

Figure 5:
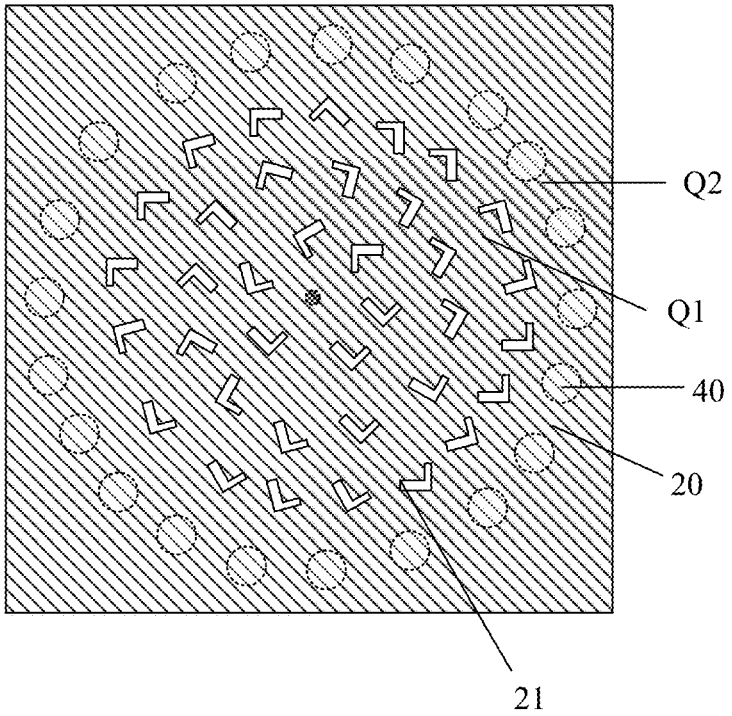
FIG. 5 is another schematic top view of a slot antenna (e.g., a plan view of the end of the slot antenna shown in FIG. 1 or 2 where the radiation layer is located) according to an embodiment of the present disclosure.
Figure 6:
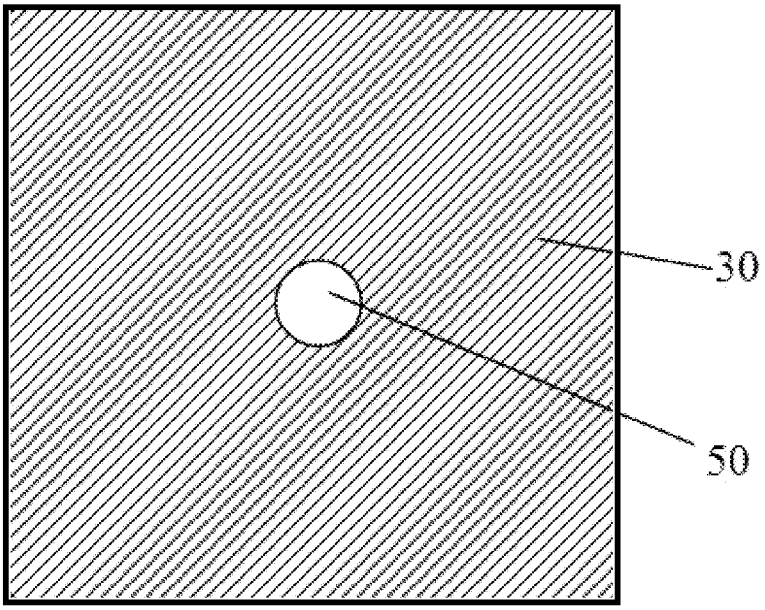
FIG. 6 is another schematic bottom view of a slot antenna (e.g., a plan view of the end of the slot antenna shown in FIG. 1 or 2 where the first shielding layer is located) according to an embodiment of the present disclosure.

In some embodiments, the radiation layer 20 has a plurality of slots 21 therein, and the plurality of slots 21 are arranged in a plurality of loops (or turns). The slots 21 in each loop are uniformly spaced apart from each other, and a distance between any adjacent two of the plurality of loops is a constant, as shown for example in FIGS. 3 and 5. As such, the electromagnetic wave radiated outward from the slot antenna according to an embodiment of the present disclosure is distributed more uniformly. It should be noted that, in the present embodiment, the structure of the slot antenna is a cylinder as an example, and therefore, the plurality of loops in which the slots 21 are arranged may be circles (i.e., the slots in each loop are arranged in respective circle), as shown in FIGS. 3 and 5. For example, as shown in FIGS. 3 and 5, the radiation region Q1 may be a circular region, in which the loops in which the slots 21 are arranged are circles. Further, a periphery of the peripheral region Q2 may be a circle (as shown in FIG. 3) or a square (as shown in FIG. 5). That is, an outline shape of the slot antenna may be the same as a shape of the radiation region Q1, i.e., may be the same as a shape in which each loop of slots 21 in the radiation region Q1 are arranged. Alternatively, the structure of the slot antenna may be a cube, and in this case, each of the plurality of loops in which the slots 21 are arranged may be a square, or a circle, as shown in FIG. 5. For example, as shown in FIG. 5, the radiation region Q1 is a circular region, in which each loop of slots 21 are arranged in a circle, and the periphery of the peripheral region Q2 is a square. That is, the outline shape of the slot antenna may be different from the shape of the radiation region Q1, i.e., different from the shape in which each loop of slots 21 in the radiation region Q1 are arranged.

It should be noted that, a shape of each of the slots 21 is not limited in an embodiment of the present disclosure. In an example, each of the slots 21 may have an L-shape, an I-shape, or the like.

In addition, the plurality of loops (of the slots 21) are concentrically arranged as concentric circles, concentric squares, or the like, and a feeding point of the feeding element 50 is arranged at a center of the plurality of loops (of the slots 21), thereby allowing an electromagnetic wave to be radiated more uniformly.

Figure 7:
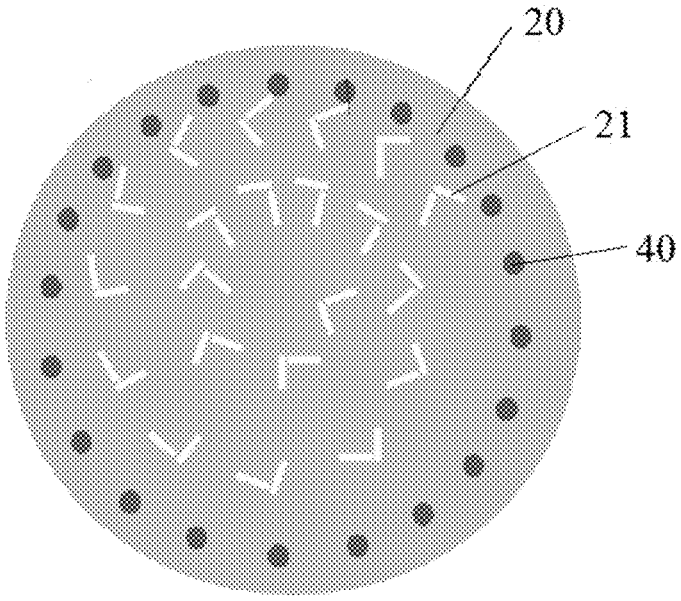
FIG. 7 is another schematic top view of a slot antenna (e.g., a plan view of the end of the slot antenna shown in FIG. 1 or 2 where the radiation layer is located) according to an embodiment of the present disclosure.
Figure 8:
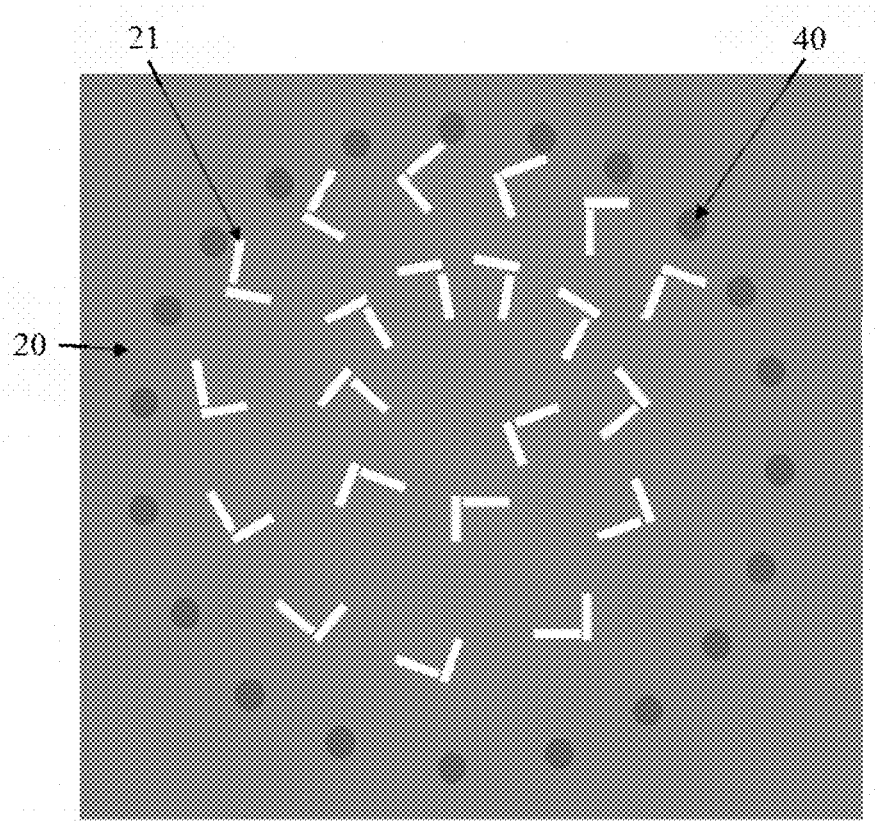
FIG. 8 is another schematic top view of a slot antenna (e.g., a plan view of the end of the slot antenna shown in FIG. 1 or 2 where the radiation layer is located) according to an embodiment of the present disclosure.

In some embodiments, the radiation layer 20 has a plurality of slots 21 therein, and the plurality of slots 21 are arranged in a spiral shape (or a spiral line); further, a distance between any adjacent two of the slots 21 (e.g., a distance between centers of any adjacent two of the slots 21) is a constant in an arrangement direction of the slots 21 (i.e., in a direction in which the slots 21 are arranged), as shown in FIG. 7 (showing the embodiment in which the slot antenna is a cylinder) and FIG. 8 (showing the embodiment in which the slot antenna is a cube). It should be noted that, the plurality of slots 21 being arranged in the spiral shape means that the plurality of slots 21 are distributed to form the spiral line, and the arrangement direction of the plurality of slots 21 is an extension direction of a curve connecting centers of the slots 21 together. As such, the electromagnetic wave radiated from the slot antenna according to the present embodiment can be distributed more uniformly.

In some embodiments, the feeding point of the feeding element 50 is located at a center of radiating region Q1 to facilitate uniform radiation of an electromagnetic wave. For example, the center of the radiation region Q1 overlaps a common center of the concentrically arranged multiple loops (of the slots 21) or overlaps a starting point of the spiral line formed by the slots 21, in the stacking direction. For example, the feeding point, at which a signal is fed into the slot antenna by the feeding element 50, of the feeding element 50 is located on the central axis of the slot antenna, as shown in FIG. 4.

In some embodiments, the thickness Td of the glass dielectric layer 10 is between 100 μm and 10 mm. For example, the thickness Td of the glass dielectric layer 10 depends on a dielectric constant of the glass dielectric layer 10 and the operating frequency of the slot antenna. For example, the slot antenna may have a plurality of operating frequencies, which may form a frequency band. In this case, the thickness Td of the glass dielectric layer 10 may be positively correlated with a center frequency of the operating band of the slot antenna. For example, the slot antenna may transmit a signal with a frequency in a high frequency band, such as in a millimeter wave band or even a terahertz band.

In some embodiments, the feeding element 50 may be a probe. As shown in FIGS. 1 and 2, an opening OP is provided in the first shielding layer 30, and a blind hole H10 is provided in the glass dielectric layer 10 at a position corresponding to the opening OP (e.g., at a position overlapping the opening OP in the stacking direction). The probe (e.g., a black needle in the blind hole H10 shown in FIG. 1 or 2) is provided in the blind hole in the glass dielectric layer 10 through the opening OP in the first shielding layer 30, and the feeding element 50 is connected to the first shielding layer 30 by means of soldering.

In some embodiments, each of the first shielding layer 30, the second shielding layer 30, and the radiation layer 20 is made of a metal, which may include, but is not limited to, a metal having a small resistance and a low signal loss, such as copper, gold, silver, or the like. In addition, each of the first shielding layer 30, the second shielding layer 30, and the radiation layer 20 may be formed by using magnetron sputtering, thermal evaporation, electroplating, or the like. Further, the metal filled in each through hole 40 may include, but is not limited to, the metal having a small resistance and a low signal loss, such as copper, gold, silver, or the like.

In a second aspect, embodiments of the present disclosure provide a communication device including the slot antenna according to any one of the foregoing embodiments. The communication device may have the same advantageous effects as those of the slot antenna, and detailed description thereof is omitted here.

It should be noted that the foregoing embodiments of the present disclosure may be combined with each other in a case of no significant conflict.

It should be understood that the above embodiments are merely exemplary embodiments adopted to explain the principles of the present disclosure, and the present disclosure is not limited thereto. It will be apparent to one of ordinary skill in the art that various changes and modifications can be made therein without departing from the spirit and scope of the present disclosure, and such changes and modifications also fall within the scope of the present disclosure.

What is claimed is:

1. A slot antenna, comprising:

a dielectric layer having a first surface and a second surface opposite to each other;

a radiation layer on the first surface of the dielectric layer, and having a plurality of slots therein; and a first shielding layer on the second surface of the dielectric layer, and electrically connected to the radiation layer;

wherein the slot antenna has a radiation region and a peripheral region surrounding the radiation region;

the dielectric layer comprises a first sub-dielectric layer and a second sub-dielectric layer, a surface of the first sub-dielectric layer distal to the second sub-dielectric layer serves as the first surface of the dielectric layer, and a surface of the second sub-dielectric layer distal to the first sub-dielectric layer serves as the second surface of the dielectric layer; and the slot antenna further comprises a second shielding layer between the first sub-dielectric layer and the second sub-dielectric layer and within the radiation region.

2. A slot antenna, comprising:

a dielectric layer having a first surface and a second surface opposite to each other;

a radiation layer on the first surface of the dielectric layer, and having a plurality of slots therein; and a first shielding layer on the second surface of the dielectric layer, and electrically connected to the radiation layer;

wherein the slot antenna has a radiation region and a peripheral region surrounding the radiation region, at least one through hole penetrating through the dielectric layer is arranged in the peripheral region, and the radiation layer is electrically connected to the first shielding layer through the at least one through hole penetrating through the dielectric layer.

3. The slot antenna according to claim 2, wherein the at least one through hole comprises a plurality of through holes, and the plurality of through holes are uniformly arranged around the radiation region.

4. The slot antenna according to claim 1, wherein the plurality of slots are arranged in a plurality of loops, a distance between any adjacent two of the slots in each loop is a fixed value, and a distance between any adjacent two of the plurality of loops is a fixed value.

5. The slot antenna according to claim 1, wherein the plurality of slots are arranged in a spiral line, and a distance between any adjacent two of the slots in a direction in which the plurality of slots are arranged is a fixed value.

6. The slot antenna according to claim 1, further comprising a feeding element for feeding an electromagnetic wave signal into the dielectric layer, wherein a feeding point of the feeding element is on a central axis of the slot antenna.

7. The slot antenna according to claim 1, wherein a material of the dielectric layer comprises at least one of glass and quartz.

8. The slot antenna according to claim 1, wherein a thickness of the dielectric layer has a positive correlation with a wavelength of an electromagnetic wave to be transmitted by the slot antenna.

9. The slot antenna according to claim 1, wherein the dielectric layer has a thickness between 100 μm and 10 mm.

10. The slot antenna according to claim 1, wherein a material of each of the radiation layer and the first shielding layer comprises a metal.

11. The slot antenna according to claim 10, wherein the metal comprises at least one of copper, gold, and silver.

12. The slot antenna according to claim 1, wherein a thickness of the dielectric layer is equal to a sum of a thickness of the first sub-dielectric layer and a thickness of the second sub-dielectric layer, and has a positive correlation with a wavelength of an electromagnetic wave to be transmitted by the slot antenna.

13. The slot antenna according to claim 6, wherein the slot antenna has a shape of a cylinder or a cube, the feeding element is on a central axis of the cylinder or the cube, and the dielectric layer surrounds the feeding element.

14. The slot antenna according to claim 13, wherein the feeding element is in the second sub-dielectric layer.

15. The slot antenna according to claim 1, wherein an edge of the second shielding layer is spaced apart from the peripheral region.

16. The slot antenna according to claim 4, wherein each of the plurality of loops is a circle, and the plurality of loops are concentric circles.

17. The slot antenna according to claim 5, wherein a starting point of the spiral line is on a central axis of the slot antenna.

18. The slot antenna according to claim 1, wherein each of the plurality of slots has an L-shape or an I-shape.

19. A communication device, comprising the slot antenna according to claim 1.

20. A communication device, comprising the slot antenna according to claim 2.

* * * * *